US007111399B2

(12) United States Patent
Stevens

(10) Patent No.: US 7,111,399 B2
(45) Date of Patent: Sep. 26, 2006

(54) UNDERCUTTER FOR A SHAVING APPARATUS

(75) Inventor: Christopher John Stevens, Reading (GB)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 11/144,493

(22) Filed: Jun. 2, 2005

(65) Prior Publication Data

US 2005/0217116 A1 Oct. 6, 2005

Related U.S. Application Data

(62) Division of application No. 10/660,974, filed on Sep. 11, 2003, now Pat. No. 6,935,027.

(30) Foreign Application Priority Data

Sep. 12, 2002 (EP) ..... 02020467

(51) Int. Cl.
*B26B 19/42* (2006.01)

(52) U.S. Cl. ..... 30/34.2; 30/43.92; 30/346.51

(58) Field of Classification Search ..... 30/34.2, 30/43, 91, 92, 346, 51, 43.91, 43.92, 346.51
See application file for complete search history.

(56) References Cited

U.S. PATENT DOCUMENTS

| | | | | |
|---|---|---|---|---|
| 2,201,349 | A * | 5/1940 | Scruggs | 30/41.6 |
| 2,223,205 | A * | 11/1940 | Godfrey | 30/43.92 |
| 2,223,294 | A | 11/1940 | Muros | 30/43.92 |
| 2,342,808 | A | 2/1944 | Johnson | 30/43.92 |
| 2,440,061 | A | 4/1948 | Page | 367/168 |
| 2,590,452 | A * | 3/1952 | Peterson | 30/34.2 |
| 3,201,178 | A * | 8/1965 | Masashi | 30/34.1 |
| 3,263,105 | A | 7/1966 | Heyek | 310/25 |
| 3,863,338 | A | 2/1975 | Wellinger et al. | 30/43.92 |
| 3,872,587 | A | 3/1975 | Wellinger | 30/43.92 |
| 4,003,130 | A | 1/1977 | Rookus | 30/34.2 |
| 4,139,940 | A | 2/1979 | Buras, Jr. | 30/43.92 |
| 6,151,780 | A * | 11/2000 | Klein | 30/43.92 |

FOREIGN PATENT DOCUMENTS

| | | |
|---|---|---|
| DE | 439916 | 12/1935 |
| EP | 0 691 187 A1 | 12/1992 |
| JP | 54-387 | 1/1979 |

* cited by examiner

*Primary Examiner*—Boyer D. Ashley
*Assistant Examiner*—Carolyn Blake
(74) *Attorney, Agent, or Firm*—Fish & Richardson P.C.; Edward S. Podszus

(57) ABSTRACT

A method of shaving with a shaving apparatus including an undercutter assembly having a primary undercutter and a secondary undercutter, the primary and secondary undercutters having interleaved blade elements. The method includes the steps of: reciprocally moving the undercutter assembly in hair shearing relation with an outer cutter; moving the primary undercutter relative to the secondary undercutter; trapping hairs which are to be cut between interleaved blade elements of the primary and secondary undercutters; pulling the trapped hairs by continued movement of the undercutter assembly in a respective reciprocation direction; and cutting the hairs between the outer cutter and the undercutter assembly.

12 Claims, 7 Drawing Sheets

UNDERCUTTER FOR A SHAVING APPARATUS

CROSS-REFERENCE TO RELATED APPLICATIONS

This application is a divisional of U.S. application Ser. No. 10/660,974, filed Sep. 11, 2003, now U.S. Pat. No. 6,935,027 which claims the benefit under 35 U.S.C. 119 of a priority application filed in Europe, serial number 02020467.3, filed Sep. 12, 2002, the entire contents of which are hereby incorporated in their entirety.

FIELD OF THE INVENTION

This invention relates to shaving apparatus and to methods for shaving hair from human skin.

BACKGROUND ART

Implements such as razors or electric shavers for cutting or shaving hair are well known in the prior art. Most prior art shaving implements for cutting human facial hair are designed to cut hair close to skin level, and preferably beneath that level without nicking or cutting the skin.

Conventional powered shaving devices typically cut individual hairs into a plurality of small pieces, leading to a dusty debris. Further, the resulting shaved skin may comprise stubble hairs which have not been cut in a fully satisfactory way.

Various attempts have been made to overcome this problem. For example, an electric dry shaver is disclosed in U.S. Pat. No. 4,139,940 (Buras, Jr.) which has projections on the outer surface of the cutting foil to move and lift low lying facial hairs for cutting by underlying blades on a blade block. The blade block includes weights to cause the blade block to be unbalanced and to vibrate and move particularly in a lateral direction, which in turn causes vibration of the housing and of the foil.

Further, U.S. Pat. No. 3,863,338 (Wellinger) describes an electric shaver comprising two cutter sections mounted in axial alignment. The two cutter sections are mounted for linear reciprocation in an aligned end-to-end relationship to avoid transmission of unpleasant vibration to the user and to avoid an unpleasant sensation due to the vibration where the shaver contacts the skin.

Furthermore, U.S. Pat. No. 3,872,587 (Wellinger) discloses an electric shaver comprising two cutter parts which extend longitudinally and parallel to each other. This arrangrment helps to avoid vibration of the shaver body in use for reasons of comfort and noise as well as for an enhanced battery life. The two cutter parts are continuously biased away from each other by two coil springs.

Also, U.S. Pat. No. 6,151,780 (Klein) describes a dry shaving apparatus comprising two inner cutters operatively associated with a common outer cutter and arranged to be driven by a drive element, respectively, in relative opposite directions and against the force of at least one spring element to avoid vibration and running noise. The spring elements acting on both inner cutters provide a permanent compensation of vibration of the inner cutters which are arranged in parallel one after the other.

U.S. Pat. No. 3,263,105 (Heyek) discloses dry shaving appliances wherein two independent cutters are each driven against a restoring spring, in order to keep the apparatus as free as possible from the mechanical vibrations produced by the motor.

Further, JP 54-387 discloses two axially aligned undercutters driven in antiphase, with a portion of the respective guide blocks interfitting in each other for guidance.

Finally, U.S. Pat. No. 2,440,061 (Page) discloses a dry shaver which comprises two end-to-end axially aligned undercutters which rotate in opposite directions due to a bevel gear arrangement.

However, conventional shaving apparatus often leaves stubble hair of a significant length in the shaved skin so that the user appears to be unshaved after a short period of time.

SUMMARY OF THE INVENTION

An object of the invention is to improve the cutting efficiency by increasing the number of cutting events or potential cutting events in a simple manner without the need to increase the speed of the drive motor.

According to one aspect of the invention, there is provided a shaving apparatus comprising:

an outer cutter having a plurality of apertures;

an undercutter assembly adjacent to said outer cutter; and a motor for reciprocally moving said undercutter assembly in a reciprocation direction;

said undercutter assembly comprising a primary undercutter and a secondary undercutter which are arranged such that blade elements of the primary secondary undercutters are mutually interleaved;

wherein the primary undercutter is coupled to said motor for driving thereof in the reciprocation direction and wherein the secondary undercutter is decoupled from the motor and is mounted for movement relative to the primary undercutter in the reciprocation direction in response to the reciprocation of the primary undercutter.

It is preferred that the secondary undercutter is caused by the primary undercutter to reciprocate in lagging relationship with the primary undercutter that the primary undercutter and the secondary undercutter can cooperate for gripping hairs between the interleaved blade elements thereof and pulling the gripped hairs prior to cutting. It is preferred that the arrangement of the two undercutters is such that improved shaving closeness can be obtained. It is preferred that the secondary undercutter be nested within the primary undercutter, which can advantageously be accomplished with a biasing member such as one or more springs. In some embodiments the secondary undercutter may be mounted by springs to the primary undercutter. In other embodiments it may be mounted on the carrier block or on the shaver head frame, or to the foil frame.

According to a further aspect of the invention, there is provided a method of shaving comprising the steps of:

reciprocally moving an undercutter assembly in contact with an outer cutter;

trapping hairs which are to be cut between interleaved blade elements of primary secondary undercutters of said undercutter assembly;

pulling said trapped hairs by continued movement of the undercutter assembly in a respective reciprocation direction; and cutting said pulled hairs between the outer cutter and the undercutter assembly.

In a further aspect of the invention, there is provided an undercutter subassembly, which is useful as a replaceable part that is assembled into a dry shaver should the original undercutter assembly become dulled or damaged. The secondary undercutter is mountable within the primary undercutter such that their respective blades are interleaved and the secondary undercutter is movable relative the primary undercutter. Such an undercutter assembly could also be supplied as a retrofit to upgrade existing models of electric shavers. The secondary undercutter can be biased either directly to the primary undercutter or independent of the primary undercutter by being biased to a carrier which supports the undercutter assembly. A method is described whereby the reciprocating primary undercutter causes the secondary undercutter to be moved, and preferably lag in relation to the primary undercutter.

When the primary undercutter is driven in a reciprocation direction, the blade elements of the undriven secondary undercutter initially lag behind the blade elements of the primary undercutter. Then, the blade elements of the primary undercutter can contact the blade elements of the secondary undercutter as a result of continued movement of the primary undercutter in the reciprocation direction and hairs are gripped between the interleaved blade elements of the primary and secondary undercutters, which form gripping elements. Thereafter, the primary undercutter moves further so that the secondary undercutter is pushed in the reciprocation direction and gripped hairs are pulled somewhat out of their follicles. The primary undercutter pushes the secondary undercutter together with the gripped hair until the adjacent surfaces of the primary and secondary undercutter have passed underneath a cutting edge of the outer cutter, so that the gripped hairs are cut by being sheared between the outer cutter and the adjacent blade elements of the undercutter assembly.

Thereafter, the primary undercutter reverses its direction, so that the above sequence of events is repeated.

By gripping and pulling the hairs between the blade element of the primary and secondary undercutter prior to cutting, debris can be cut off with a greater length as compared to conventional dry shaving. Additionally, the stubble hairs which remain in the skin are shorter, since the gripped hairs are pulled prior to cutting and the remaining stubble hairs retreat after cutting (the so-called hysteresis effect). As a result, improved closeness is achieved so that a smooth shaved skin is obtained.

BRIEF DESCRIPTION OF THE DRAWINGS

Embodiments of the invention will now be described with reference to the accompanying drawings, in which.

DESCRIPTION OF PREFERRED EMBODIMENTS AND BEST MODE OF PRACTICING THE INVENTION

Figure 1:
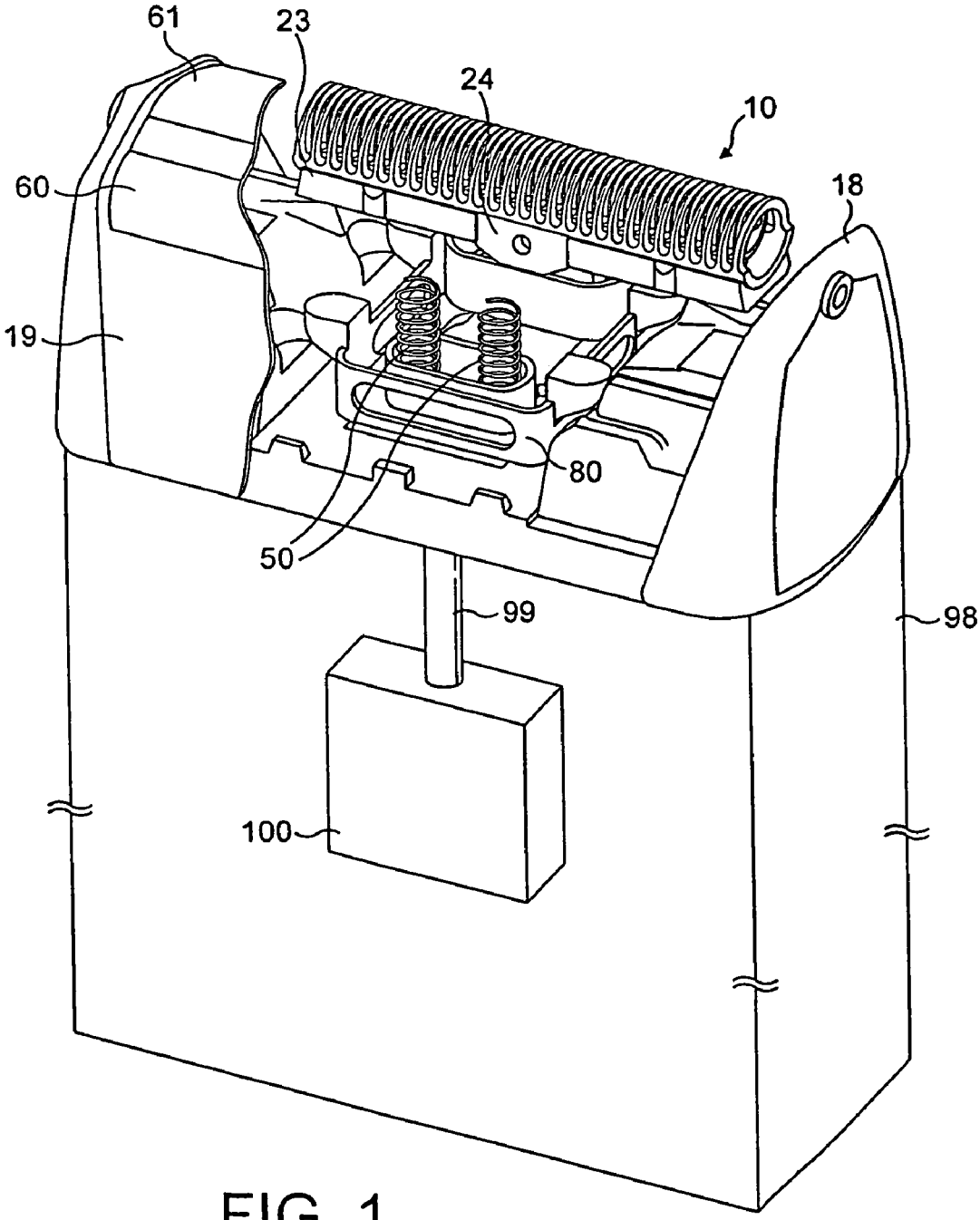
FIG. 1 is a perspective view of a shaver having a shaver head having two cutter units with the outer cutters removed and one undercutter assembly shown only in part.

FIG. 1 shows a shaver having a shaver head of the type having two cutter units, each having a respective undercutter assembly and an outer cutter or foil. For clarity, FIG. 1 shows only a scrap view of the outer cutters 60,61 (which are conventional) mounted in a foil frame 19. A first undercutter assembly 10 is shown complete in its assembled condition. Only part of the second undercutter assembly is shown.

Each undercutter assembly such as 10 comprises a primary cutter, a secondary cutter, a support block 23, and a sub-mounting 80 which carries a spring 50, preferably at least two springs 50, as illustrated in FIG. 1. For the second undercutter assembly, only the sub-mounting 80 and two springs 50 are shown. It is understood that presence of spring or springs 50 is not essential to practicing the present invention, but is preferred for better shaving efficiency. It is understood that the sub-mounting 80 is part of the drive block, which is known in the art and is conventionally driven by a motor in the handle unit housing 98, via a drive shaft 99. As is known in the art, sub-mounting 80 is removably attached to the shaver by a drive member, e.g. a pin 90, which connects it to the drive pin of the shaver, and is shown in FIG. 1A.

Figure 1A:
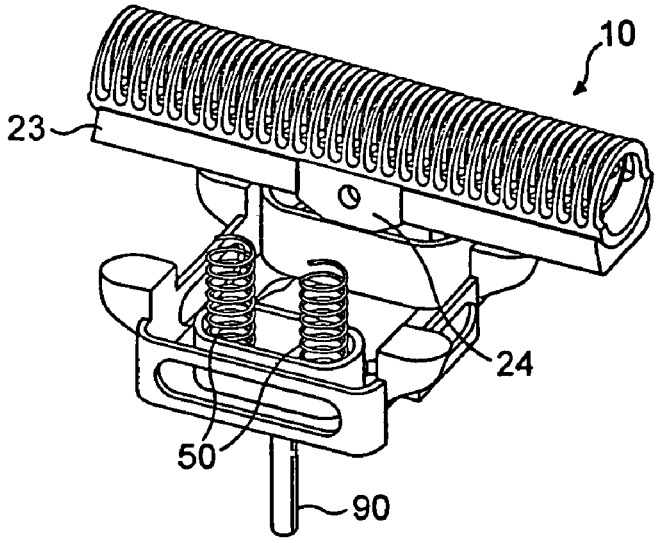
FIG. 1A is a perspective view of an undercutter unit for use in the shaver head of FIG. 1.

FIG. 1A shows an undercutter unit comprising the first and second undercutter assemblies of FIG. 1. Each undercutter assembly, such as assembly 10 as shown, is mounted on the common sub-mounting 80, which also provides a downwardly depending drive member 90, which is commonly formed as a pin member, which engages with a complementary recess on the drive housing to receive motive power from the shaver motor 100.

Figure 2:
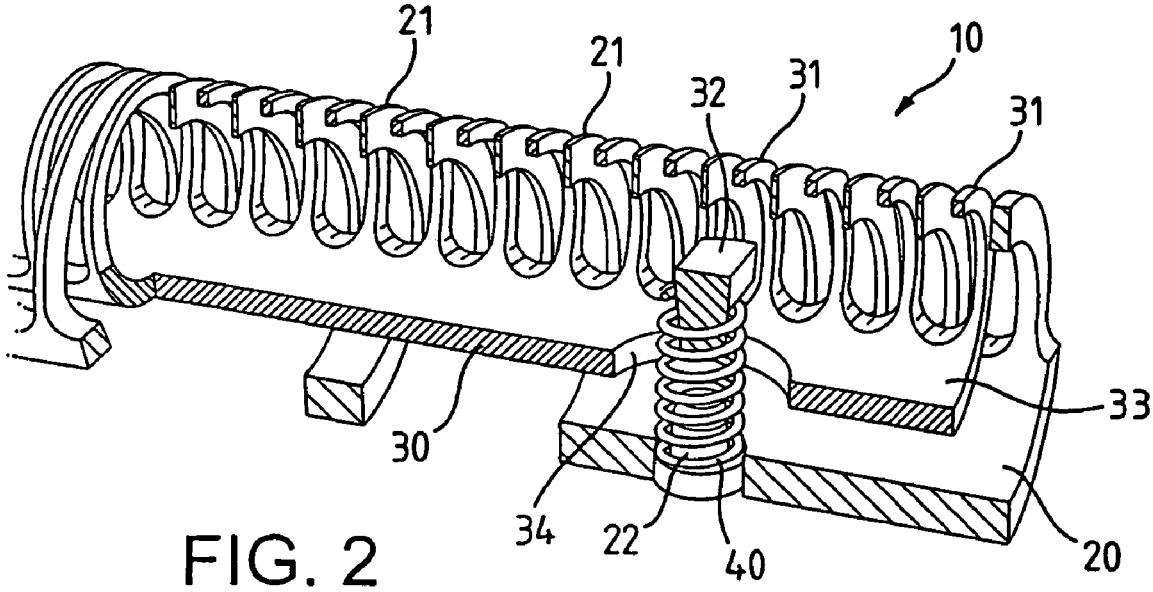
FIG. 2 is a perspective view partly broken away of an undercutter assembly in a rest position in shaving apparatus according to an embodiment of the invention.

FIG. 2 shows a perspective view of the first undercutter assembly 10 comprising a primary undercutter 20 and a secondary undercutter 30, with the support block removed. The primary undercutter 20 and the secondary undercutter 30 are partly shown in cross section along a vertical plane which divides both elements substantially into two halves.

The primary undercutter 20 comprises a plurality of blade elements 21 which are uniformly spaced apart and have an annular form, so that the outer and inner surfaces of the blade elements 21 each substantially form a semi-cylindrical shape. Similar to the primary undercutter 20, the secondary undercutter 30 comprises a plurality of blade elements 31 which are uniformly spaced apart and have a substantially annular form, so that the outer and inner surfaces of the blade elements of the secondary undercutter each also substantially form a semi-cylindrical shape. The blade elements 31 are interleaved with the blade elements 21 of the primary undercutter.

FIG. 2 shows a static or neutral position of the undercutter assembly 10, where the blade elements 21 of the primary undercutter and the blade elements 31 of the secondary undercutter 30 are equidistant from one another. It will be understood that the secondary undercutter 30 of semi-cylindrical shape is adapted to be nested within the semi-cylindrical shape of the primary undercutter 20, to achieve the interleaving of the blade elements.

For positioning of the secondary undercutter 30 relative to the primary undercutter 20, a secondary spring element 40 is provided which is coupled to the primary undercutter 20, on the one hand, and the secondary undercutter 30, on the other hand. The secondary spring element 40 is preferably a coil spring. While in some arrangements one spring element 40 could be used, it is preferred to have two spring elements 40, one at each end. In particular, the coil spring 40 is connected at one end to the primary undercutter 20 by means of a boss or protrusion 22, which extends from support block 23 of the primary undercutter 20 that is substantially opposite to the blade elements 21 of the primary undercutter 20. The other end of the spiral spring 40 is connected to a lug 32 arranged within the semi-cylindrical shape of the secondary undercutter 30. A base plate 33 of the secondary undercutter 30 has a recess 34 through which the coil spring 40 passes from the boss 22 of the primary undercutter 20 to the lug 32 of the secondary undercutter 30. In the static position shown in FIG. 2, the coil spring 40 may optionally be preloaded to bias the secondary undercutter 30 into engagement with the outer shaving foil 60 (see FIG. 8*a*).

Figure 3:
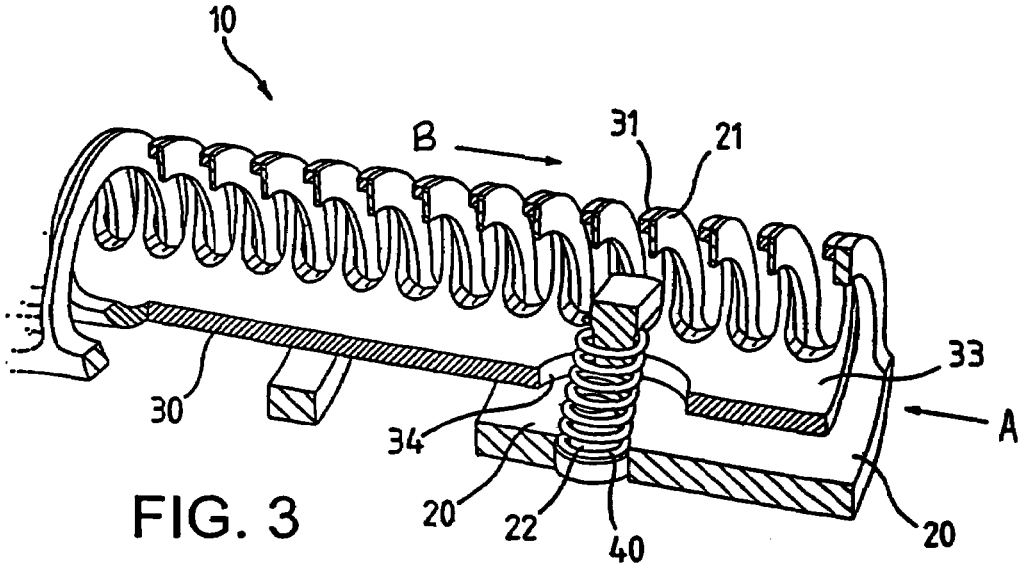
FIG. 3 is a perspective view partly broken away of the undercutter assembly of FIG. 2 with a primary undercutter moving in a first direction.

FIG. 3 shows the cutter assembly 10 of FIG. 2 when the primary undercutter 20 is moving to the left (as indicated by arrow A) in one direction of the reciprocating movement caused by the motor (FIG. 1), whilst the secondary undercutter 30 is still moving to the right (as indicated by arrow B) in the other direction of the reciprocating movement, due to its inertia. The coil spring 40 serves as a resilient connection between the primary undercutter 20 and the secondary undercutter 30, so that the blade elements 31 of the secondary undercutter 30, which is decoupled from the motor, lag behind the blade elements 21 of the driven primary undercutter 20. This action of using the moving primary undercutter to actuate the mass of the secondary undercutter is a reason that the secondary undercutter may be termed, as a matter of convenience, an "inertial undercutter".

In FIG. 3, the blade elements 21, 31 of the primary and secondary undercutters 20, 30 are shown contacting each other at adjacent surfaces, and thus hairs can be trapped in between these adjacent surfaces of the blade elements 21, 31 to produce a "tweezer effect". By virtue of the movement of the primary undercutter 20, and the lagging of the secondary undercutter 30, the spiral spring 40 is extended with one end of the spiral spring 40 displaced further in the reciprocation direction than the other end, so that the spring is inclined to the right as shown in FIG. 3. This is achieved without changing the position of the primary undercutter 20 relative to the secondary undercutter 30 in a direction normal to the reciprocation direction.

Figure 4:
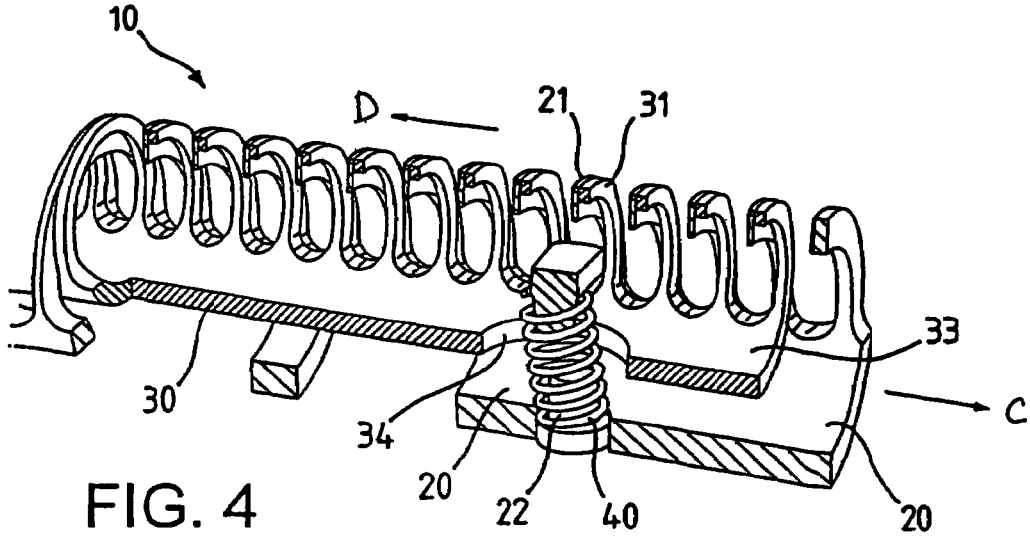
FIG. 4 is a perspective view partly broken away of the undercutter assembly of FIGS. 2 and 3 with the primary undercutter driven in a second direction.

As can be seen in FIG. 4, when the primary undercutter 20 is driven to the right as indicated by arrow C, and the secondary undercutter 30 is still moving to the left due to its inertia, as indicated by arrow D, the same hair trapping or tweezer effect occurs as discussed with respect to FIG. 3. The coil spring 40 is now inclined and extended to the left.

As a result of the lateral movement of the primary undercutter 20 as described above, adjacent blade elements of the primary and secondary undercutters come into contact with one another as the blade elements 31 of the secondary undercutter lag behind the blade elements 21 of the primary undercutter 31, due to the inertia of the secondary undercutter, friction forces from contact with the foil, and the spring connection between the primary and secondary undercutters 20, 30. By virtue of the reciprocating movement of the primary undercutter 20, 30 each blade element 21 of the primary undercutter 20 comes into contact alternately with the adjacent right and left blade elements 31 of the secondary undercutter 30 corresponding to the reciprocation direction of the primary undercutter 20, as can be understood from FIGS. 3 and 4.

As a result of the resilient support of the secondary undercutter 30 by the coil spring 40 and as a result of the contact of the blade elements 21, 31 of the primary and secondary undercutter 20, 30, the secondary undercutter 30 can bounce back and forth, due to its inertia, between the driven blade elements 21 of the primary undercutter 20, so that the primary undercutter 20 and the secondary undercutter 30 cooperate to trap and pull hairs between their interleaved blade elements 21, 31 prior to cutting, as will be described hereinafter in more detail.

Some factors that are likely to influence the motion of the secondary undercutter include: foil loading, secondary spring pressure, speed of oscillation, deformation of individual blades, asymmetries in either the undercutter construction or the drive motion, and the mass of the secondary undercutter. The secondary undercutter itself typically weighs 0.39 grams. Optionally, it can be fitted with a steel "bob-weight" attached inside at each end of the undercutter; for example weights up to 0.17 gram each could be accommodated without interfering with the spring mountings, thus the additional mass of the two bob-weights representing an 87% increase in the mass.

Figure 5:
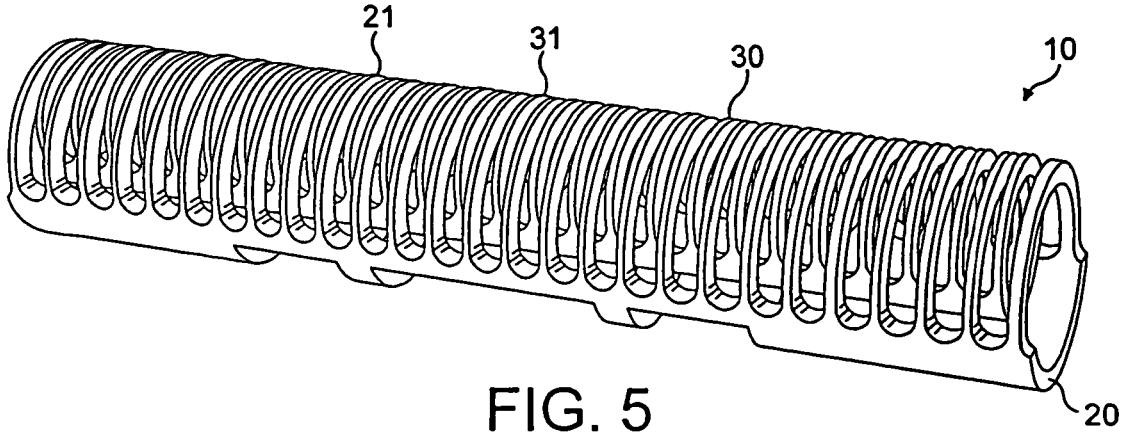
FIG. 5 is a perspective view of the undercutter assembly of FIGS. 2 to 4.

FIG. 5 shows a perspective view of the cutters of undercutter assembly 10. The secondary undercutter 30 is nested inside the primary undercutter 20, with the blade elements 21, 31, respectively, of the primary and secondary undercutters 20, 30 mutually interleaved as described above. The blade elements 21, 31 of the primary and secondary undercutters 20, 30 are both arcuate, and the outer diameter of the blade elements 31 of the secondary undercutter 30 are ground to match the outer diameter of the blade elements 21 of the primary undercutter 20.

In practical tests comparing a production-type BRAUN® electric shaver Model 6017, (widely sold in the United States and Europe under the trade designation SYNCRO®), with the same model modified according to the embodiment of the type shown in FIGS. 1 to 5, it was observed from a histogram analysis of shaving debris that the modified Model 6017 having the undercutter assembly of the present invention cut more hairs of a longer length than the standard Model 6017 shaver, with a corresponding reduction in the number of shorter (less than 50 micron length) hair. Thus, there was advantageously less short "dust"-type debris (about half as much) which might tend to foul the parts and be more difficult to clean from the shaver elements.

Figure 6:
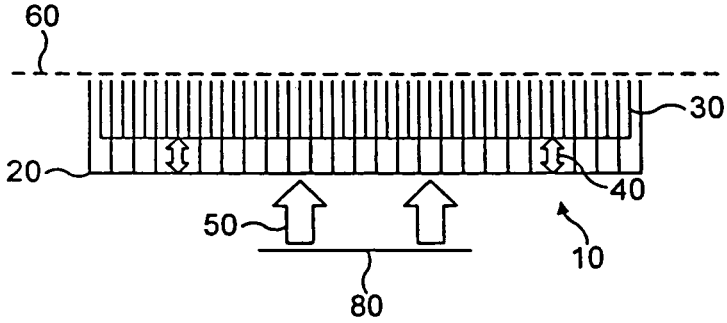
FIG. 6 is a schematic view of a shaver head according to a first embodiment of the invention.
Figure 7:
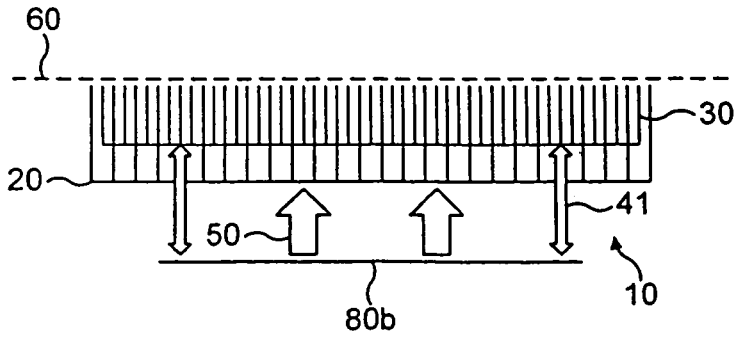
FIG. 7 is a schematic view of a shaver head according to a second embodiment of the invention.

The support block 23 of the undercutter assembly has an engagement region 24 for receiving elements that transfer the reciprocating movement of the motor to the primary undercutter 20. As seen in FIG. 1A, engagement region 24 is pinned at the circular region to a separate cover piece which covers springs 50 and resiliently rides on springs 50; the attachment of engagement region 24 is preferably pivotally pinned to this cover piece. Furthermore, the support block 23 can have receiving sections which are accessible from below for receiving the pair of primary biasing elements 50 as shown in FIGS. 1, 6 and 7. The support block 23 and sub-mounting 80 or 80*b* can be removable as a unit for convenient replacement, since the sub-mounting 80 or 80*b* can have on its underside attachment structure such as the pin or lug 90 shown in FIG. 1A, which is known in the art as shown in U.S. Pat. No. 6,098,289 (Wetzel) which is incorporated by reference (see for example therein drive pin 44 in FIGS. 2 and 11), to removably connect the assembly to the main drive member 99 (driven by the motor 100) that is retained in the shaver body housing 98. Alternatively, support block 23 can have attachment structure so that it is possible to exchange just the primary and secondary undercutters while leaving sub-mounting 80 or 80*b* in place, such as by having on the underside of the primary undercutter a rib defining detent structure or an opening into which an arm or protrusion formed on an upper surface of sub-mounting 80 or 80*b* can be snapped or retained, as shown in either of U.S. Pat. No. 5,159,755 (Jestädt et al.) or U.S. Pat. No. 4,797,997 (Packham et al.), each of which is hereby incorporated by reference.

FIGS. 6 and 7 illustrate, schematically, embodiments of shaver heads which comprise an outer cutter, that is a cutting foil 60, adjacent to the undercutter assembly 10, consisting of the primary and secondary undercutters 20, 30 whose blades are interleaved. As described with reference to FIGS. 1 to 4, the arrangement of FIG. 6 has a pair of secondary spring elements 40 arranged between the primary undercutter 20 and the secondary undercutter 30. In this arrangement, with the primary and secondary spring elements in series, the secondary undercutter is referred to as being "internally sprung". In such an arrangement, the preload of the primary biasing elements 50 influences the preload of the secondary biasing elements 40, and vice versa, since they are coupled. Therefore, the preload of the secondary biasing elements 40 causes the primary undercutter 20 to be pushed away from the cutting foil 60 by the preload of the secondary biasing elements 40, which may possibly decrease the cutting efficiency. For example, primary springs were selected that apply a nominal loading force of 200 gram against the shaving foil, which is in the loading range of conventional undercutters such as in commercially available shavers from BRAUN® sold under the designation Model 6016. However, the resultant primary undercutter loading against the shaving foil was then 200 gm minus the secondary spring loading. The nominal loading of the primary undercutter can alternatively be 180 grams, which is known in commercial shavers from BRAUN® sold under the designation Model 6017; thus a primary nominal loading in the range of 150–200 grams is common.

Figure 9:
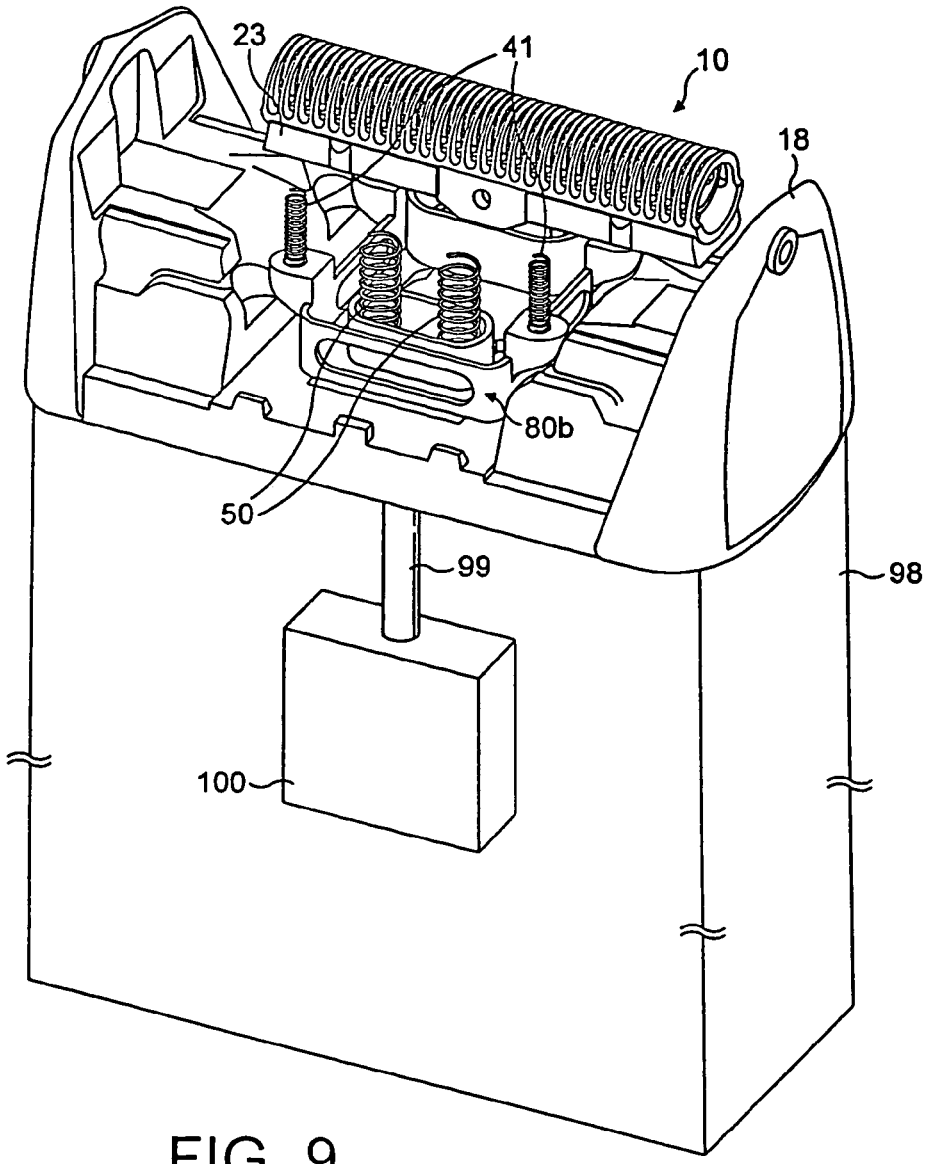
FIG. 9 shows a perspective view of a shaver having a shaver head having two cutter assemblies of the type shown in FIG. 7, with the outer cutter removed, and one undercutter assembly shown only in part to expose the bias springs.

In an alternative arrangement which tends to optimise the cutting efficiency, biasing elements as illustrated in FIG. 7 can be employed. A pair of secondary biasing elements 41 extend from the secondary undercutter 30 through the primary undercutter 20 to mounting points which are not arranged at the primary undercutter 20. In this arrangement with the primary and secondary springs in parallel the secondary undercutter is referred to as being "independently sprung". Thus, the primary biasing element 50 and the secondary biasing element 41 are arranged in a similar manner, and preferably carried on a fixed spring carrier 80*b* (shown schematically in FIG. 7) to avoid interference between the preloads of the primary undercutter 20 and the secondary undercutter 30. This arrangement maintains the primary undercutter spring loading of nominally 200 grams, unaffected by the secondary loading. A more detailed view of the arrangement of FIG. 7 is shown in FIG. 9. As with FIG. 1, the outer cutters are omitted and one undercutter assembly is shown only in part to expose the springs. It has been observed that the secondary undercutter, when using the "independently sprung" arrangement, moves in a more controlled and regular manner than with the "internally sprung" arrangement, with a more distinct flip-flop action (that is, where the secondary blade elements meet the primary blade elements at each end of the stroke) and less bouncing when its blade elements make contact with the blade elements of the primary undercutter.

The spring carrier 80*b* is similar to the sub-mounting 80 but is extended to include additional ears or wings to position secondary springs 41. It is not necessary that the biasing elements 41 be mounted to the same structure as biasing elements 50. Since the primary undercutter preferably has a tubular shape open at both ends, it will be understood that, in an alternative embodiment, biasing elements 41 could extend out the ends of primary undercutter 20 and be mounted to support pins formed on the foil supporting frame 19 which is attached to head frame 18, or alternatively to the head frame 18 directly, each of which is static relative to primary undercutter 20, although such a construction is less preferred from the standpoint of easy interchangeability of the shaving foil or undercutter assembly.

The arrangement of FIG. 7 also offers easier access to the springs, avoids production variation problems associated with "short springs", and also offers a possibility for convenient adjustability by the user of the spring force of the secondary springs, for example by having the spring connected to a set screw that is accessible through the shaver housing by a user's finger to adjust the preload. The spring bias has been varied stepwise to supply a nominal loading of the secondary undercutter against the shaving foil of 50–60 grams to 300 grams and slightly above. A nominal loading of 60 gram is understood to be satisfactory for the secondary undercutter. It is also understood that a nominal loading of 160 grams is also acceptable, and it may be preferable to have this nominal loading in the range of 50 to 200 grams. Thus, in some embodiments the nominal loading of the secondary undercutter is lower than or up to about the same as the nominal loading of the primary undercutter.

In shave tests, the internally sprung arrangement initially had a preload of 120 gram, but this was reduced to 50 gram to minimize the effect on the primary undercutter loading. In further tests using the independently sprung arrangement, the secondary preload could then be varied without affecting the primary loading. A comparison of 160 gram preload with 60 gram preload indicated that 60 gram was preferred by the test subjects, so this preload was selected for subsequent testing.

In tests on a rig, it has been shown that with an increasing secondary bias, friction between the undercutter and shaving foil may reach a point where the inertial action of the secondary undercutter tends to be lost. If the secondary cutter bias is increased too much, which in tests occurs in the region of about 230 grams nominal loading, the springs, if not stiff enough, buckle slightly causing the secondary undercutter to rotate within the primary undercutter with the consequence that the curved lower profiles of the gap between the two sets of undercutter blades prevent their mutual contact and the "gripping" action may decrease. Under a nominal loading of 320 grams it was observed that the secondary undercutter still performed as expected, though effects of increasing friction became evident as the cutter slowed down. However, under some circumstances, even a nominal loading of 260 grams could be too high and possibly cause the shaving foil to become dislodged. With light external loading applied to the foil, the secondary undercutter was observed to drag at 200 g and to stop at 280 g.

Referring now to FIGS. 8*a* to 8*i*, the operation of the shaving apparatus as presently understood will now be described in more detail. When the skin to be shaved (not shown) is in contact with the cutting foil 60, hairs 70 extend through apertures 61 of the cutting foil 60 for engagement with the undercutter assembly including blade elements 21 and 31. The positions of the primary undercutter blades 21 and the secondary undercutter blades 31 in FIG. 8*a* correspond to their positions in FIG. 1, with the primary blade elements 21 spaced equidistantly from the secondary blade elements 31. As indicated by the two arrows, the primary blade elements 21 are initially to be moved in a first lateral direction (to the left) by a motor (not shown). Since the secondary blade elements 31 are not driven by the motor, or at least not directly, their position relative to the cutting foil is considered to remain as substantially unchanged during the first lateral movement of the primary elements 21, due to the inertia of the secondary blade elements 31. However, dynamic effects may cause a variety of relative movements of the secondary blade elements 31 which are not considered in the following.

Figure 8A:
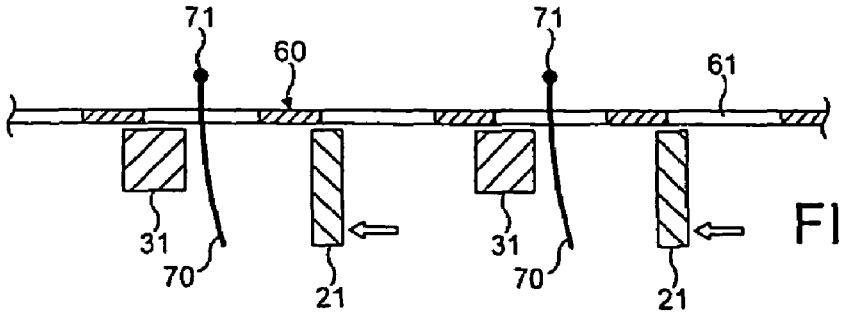
FIGS. 8*a* to 8*i* show schematic views of blade elements of an undercutter assembly and a cutting foil sequentially illustrating the operation of a shaving apparatus according to an embodiment of the invention.
Figure 8B:
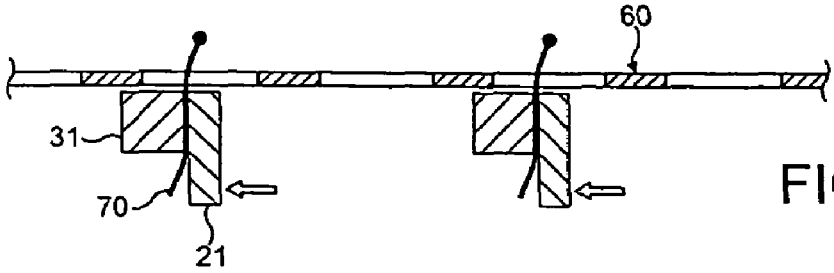

As shown in FIG. 8*b*, the primary blade elements 21 catch the hairs 70 and push them against the secondary blade elements 31 so that the hairs 70 are pinched between adjacent blade elements 21, 31 of the primary and secondary undercutter 20, 30.

Figure 8C:
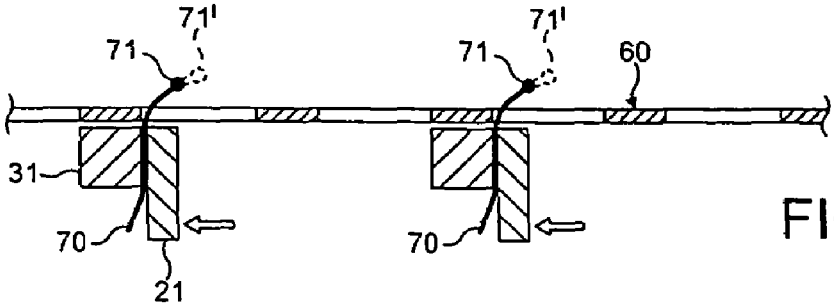

As the primary blade elements 21 then move further in the first lateral direction (to the left), the secondary blade elements 31 are pushed by the primary blade elements 21, also to the left, with the hairs 70 trapped between the adjacent blade surfaces, so that the hairs are pulled. As a result, the root 71 of the hair 70 is pulled somewhat out of its follicle and towards the edge of an aperture in the cutting foil 60, as indicated in FIGS. 8*c* and 8*d* where the original position of the root 71' in shown in ghost lines.

Figure 8D:
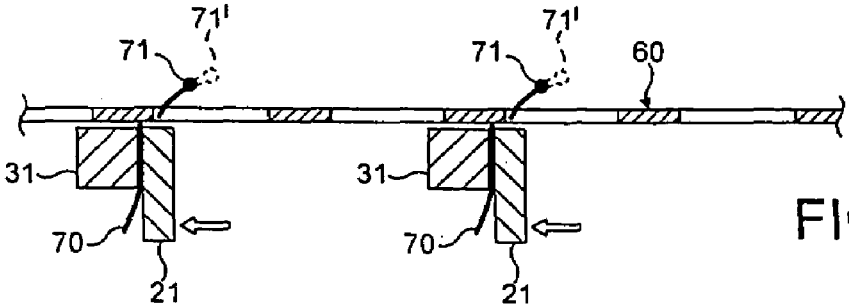

FIG. 8*d* shows that the hair 70 is cut while being trapped between adjacent surfaces of primary and secondary blade elements 21, 31. The hair 70 is sheared as a result of co-operation between the blade elements and the cutting foil. However, the hairs 70 can also be sheared when not trapped between adjacent surfaces of primary and secondary blade elements, but simply while they are pushed only by a single blade element of the primary or secondary undercutter 20, 30.

Figure 8E:
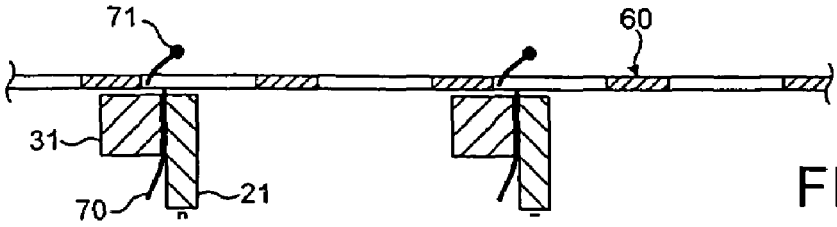

FIG. 8*e* shows the primary blade elements 21 being driven in a second lateral direction (to the right) opposite to the first lateral direction, due to the reciprocating movement of the primary undercutter 20, as indicated by the two arrows. Thereby, the secondary blade elements 31 lose contact with the primary blade elements 21, and become spaced apart from each other due to inertial effect of the secondary undercutter 30. Since the hairs 70 have just been cut as shown in FIG. 8*d*, the root 71 of the hair 70 then retreats into the follicle back to its original position, so that the remaining stubble hair moves beneath the skin surface, resulting in improved closeness.

Figure 8F:
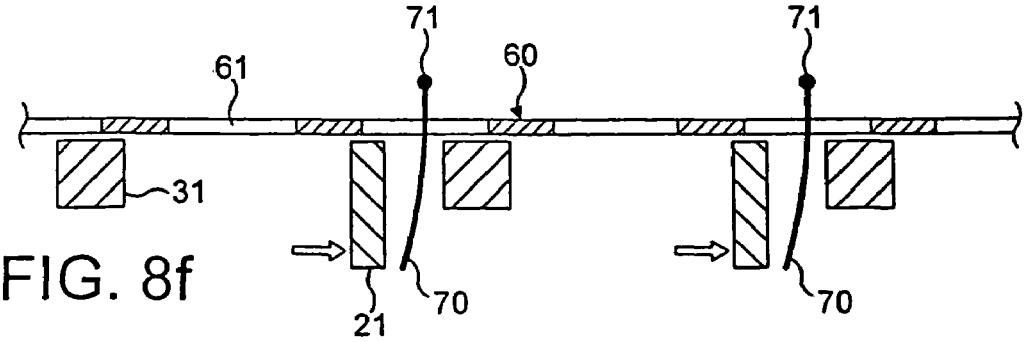
Figure 8G:
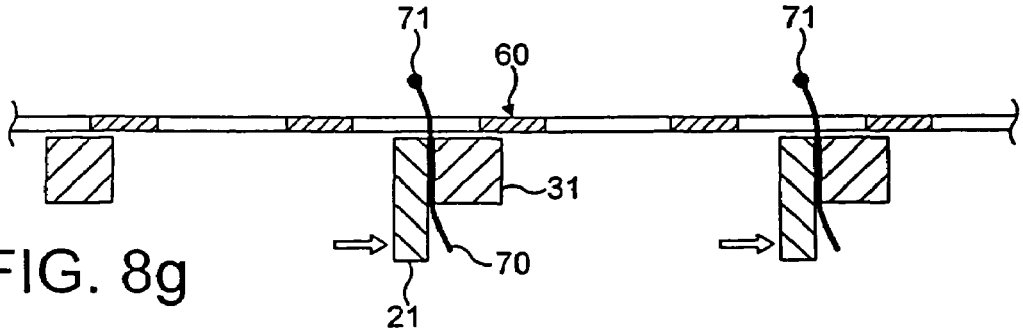
Figure 8H:
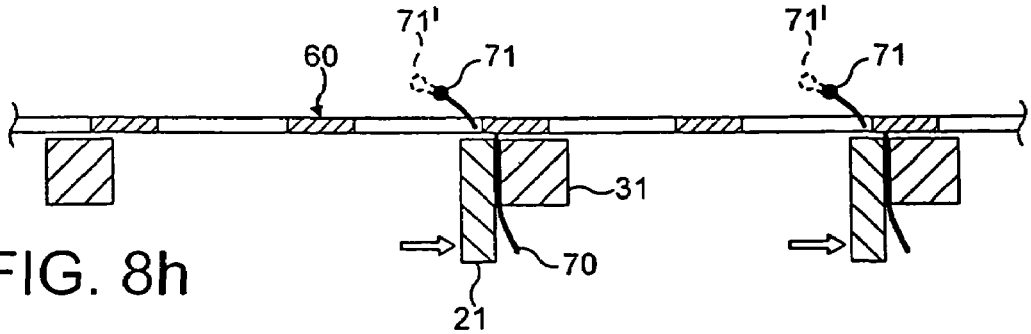
Figure 8I:
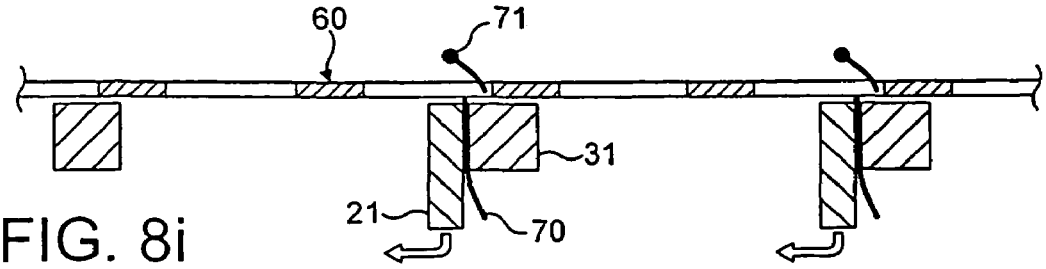

Regarding FIGS. 8*f* to 8*i* the same sequence of operational steps takes place but in mirror image to the corresponding FIGS. 8*a* to 8*e*. In particular, FIG. 8*f* shows primary blade elements 21 moving further in the second direction and coming into contact with new hairs 70 which pass through the apertures 61 of the cutting foil 60. In FIG. 8*g* the hair is then trapped between adjacent primary and secondary blade elements 21, 31 and pulled prior to being cut. Thereafter, the hairs are cut, while being pulled, as described above. As indicated by FIG. 8*i*, the primary blade elements 21 then move back in the first direction due to the reciprocating movement of the primary undercutter 20 and the roots 71 of the hairs 70 move back again into their follicles to adopt the original positions.

The above-described sequence is then repeated, starting from FIG. 8*a* again. However, it should be mentioned that the above schematic illustration is only one possibility as to how hairs can be trapped between adjacent blade elements and pulled out of their follicles, prior to being cut while they are still trapped. Also, hairs can be cut after they have been trapped and pulled away from their follicles by adjacent primary and secondary blade elements, or in the normal way without being pulled. The reason for this is that the secondary blade elements will bounce back and forth between the driven primary blade elements. Alternatively, the secondary undercutter can be mounted for movement relative to the primary undercutter in the reciprocation direction by a resilient or movable support of the secondary undercutter, e.g. ball bearings in the housing. Furthermore, the secondary undercutter can also be freely movable between the interleaving blade elements of the primary undercutter, that is, guided within the primary undercutter but not biased by a spring relative to the primary undercutter.

Whereas the embodiments described above envisage that both the primary and secondary undercutters are manufactured from metal, the secondary undercutter may alternatively be manufactured from a plastics material. In particular, it may be manufactured by machining from a solid rod with the blades formed by circumferential grooves cut into its surface. A plastics material secondary undercutter may be quieter in operation than a metal one as well as providing the option of including filler particles, for example, carbide, for improved gripping action and wear resistance. The blade elements of the secondary undercutter do not have to be sharpened, even if they are made of metal; they could for example be relatively blunt, they could have a high friction coating, or they may be ground to only cut hairs in one direction of travel. They could, for example, be made of plastic and textured and/or include an elastomer to provide a good frictional surface.

Figure 10:
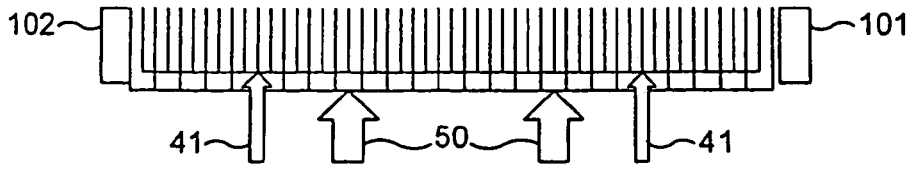
FIG. 10 shows a modification of the embodiment of FIG. 7.

Another possible embodiment, shown schematically in FIG. 10 involves the use of magnets 101, 102 in order to increase the gripping effect over that provided by the inertial effect alone. For such an embodiment magnets 101, 102 would be disposed at the ends of the undercutters, the secondary undercutter for example providing poles of one polarity at the ends of a plastics undercutter, and the primary undercutter providing poles of the opposite polarity at its ends, thereby achieving a flip-flop action and biasing the blades to either be in the gripping position at the right or the left. It will be understood that the magnets can be used with a spring arrangement of the type shown in either FIG. 6 or FIG. 7.

As will be appreciated, if the primary undercutter is a standard undercutter, adding the secondary undercutter will effectively double the number of blades, and possibly result in reduced shaving efficiently due to there being too many blades oscillating beneath the foil. The primary undercutter may therefore desirably have less blades than a standard undercutter, so that when a secondary undercutter with a similar number of blades to the primary undercutter is employed, an undercutter with the same number of blades overall as a standard undercutter results.

Because the secondary undercutter is nested within the primary undercutter it is less wide, so the secondary undercutter is tangential with the shaving foil in an effective cutting range, in the width direction, of somewhat less than 4 mm. However, in arrangements where the secondary undercutter had a similar distribution of blade elements as a conventional primary undercutter (e.g., 27 blade elements each of 0.12 mm thickness evenly spaced over a length of 31 mm as in commercial BRAUN® shavers sold under the SYNCRO® designation Model 6016 or 6017), each blade element of the secondary undercutter was observed, during linear reciprocation, to move across five (5) of the honeycomb-like-distributed apertures in the shaving foil (each of which has a typical size of 0.6 mm in width), in comparison to the blade elements of the primary undercutter which moved across only three (3) apertures, thus the secondary undercutter moved 66% more than the primary undercutter, generating more possible blade element-to-aperture interactions, and increasing the likelihood of generating a hair cutting event especially whenever the blade elements of the two undercutters remain in hair-trapping or clamping relation for a distance of travel exceeding 0.6 mm.

It has been observed that since the secondary undercutter adds extra mass to the dynamic system, it may result in an increase in shaver head and body vibration, and that it may be beneficial to add a counterbalance weight attached to the motor to counteract that.

Further modifications will occur to those skilled in the art. All such modifications are intended to be covered by the following claims, irrespective of their summary in the claims.

What is claimed is:

1. A method of shaving with a shaving apparatus including an undercutter assembly having a primary undercutter and a secondary undercutter, said primary and secondary undercutters having interleaved blade elements; the method comprising the steps of:

reciprocally moving the undercutter assembly in hair shearing relation with an outer cutter;

moving the primary undercutter relative to the secondary undercutter;

trapping hairs between opposing faces of adjacent interleaved blade elements of the primary and secondary undercutters, the opposing faces extending between inner and outer surfaces of the interleaved blade elements;

pulling said trapped hairs by continued movement of the undercutter assembly in a respective reciprocation direction; and cutting said hairs between the outer cutter and the undercutter assembly.

2. A method of shaving with a shaving apparatus including an undercutter assembly having a primary undercutter and a secondary undercutter, said primary and secondary undercutters having interleaved blade elements; the method comprising the steps of:

reciprocally moving the primary and secondary undercutters of the undercutter assembly in hair shearing relation with an outer cutter;

moving the primary undercutter relative to the secondary undercutter in a first reciprocation direction;

whereby said moving primary undercutter entrains the secondary undercutter and continued movement of the primary undercutter causes the secondary undercutter to move with the primary undercutter in the first reciprocation direction, reversing direction of moving the primary undercutter, whereby continued motion of the primary undercutter causes the secondary undercutter to reverse direction, and cutting hairs between the outer cutter and both the primary and secondary undercutters of the undercutter assembly.

3. The method of claim 1, including the step of causing the secondary blade elements to move relative to the primary blade elements in the reciprocation direction in a lagging relation thereto to provide contact between adjacent blade elements for trapping said hairs.

4. The method of claim 3, wherein the blade elements of the secondary undercutter lag relative to the blade elements of the primary undercutter in response to inertia of the secondary undercutter.

5. The method of claim 1, further comprising the steps of:

biasing the blade elements of the primary undercutter towards the outer cutter by a primary biasing element; and biasing the blade elements of the secondary undercutter towards the outer cutter by a secondary biasing element.

6. The method of claim 5, further comprising the step of positioning the secondary biasing element between the secondary undercutter and the primary undercutter.

7. The method of claim 5, for use with shaving apparatus further having a carrier external of the primary undercutter, and the method further comprising the steps of:

biasing the primary undercutter to the carrier through the primary biasing element; and biasing the secondary undercutter to the carrier through the secondary biasing element.

8. The method of claim 2, including the step of causing the secondary blade elements to move relative to the primary blade elements in the reciprocation direction in a lagging relation thereto to provide contact between adjacent blade elements for trapping said hairs.

9. The method of claim 8, wherein the blade elements of the secondary undercutter lag relative to the blade elements of the primary undercutter in response to inertia of the secondary undercutter.

10. The method of claim 2, further comprising the steps of:

biasing the blade elements of the primary undercutter towards the outer cutter by a primary biasing element; and biasing the blade elements of the secondary undercutter towards the outer cutter by a secondary biasing element.

11. The method of claim 10, further comprising the step of positioning the secondary biasing element between the secondary undercutter and the primary undercutter.

12. The method of claim 10, for usewith shaving apparatus further having a carrier external of the primary undercutter, and the method further comprising the steps of:

biasing the primary undercutter to the carrier through the primary biasing element; and biasing the secondary undercutter to the carrier through the secondary biasing element.

* * * * *